United States Patent [19]

Kovach et al.

[11] 4,159,510

[45] Jun. 26, 1979

[54] HIGH-INTENSITY LAMP HAVING HIGH PULSE REPETITION RATE AND NARROW PULSE-WIDTH

[75] Inventors: Ronald J. Kovach; Charles G. Marianik, both of London, Canada

[73] Assignee: Photochemical Research Associates, Inc., London, Canada

[21] Appl. No.: 817,843

[22] Filed: Jul. 21, 1977

[30] Foreign Application Priority Data

Aug. 25, 1976 [CA] Canada ..... 259799

[51] Int. Cl.[2] ..... H01J 5/16; H01J 7/44; H01J 17/34

[52] U.S. Cl. ..... 362/265; 315/36; 315/53; 315/59; 315/70; 313/110

[58] Field of Search ..... 362/265; 315/36, 59, 315/53, 57, 42, 44, 45, 70

[56] References Cited

U.S. PATENT DOCUMENTS

| | | | |
|---|---|---|---|
| 2,409,030 | 10/1946 | Fraenckel et al. | 315/53 X |
| 3,479,555 | 11/1969 | Garwin | 315/59 X |

*Primary Examiner*—Alfred E. Smith
*Assistant Examiner*—Charles F. Roberts

[57] ABSTRACT

A high intensity light source having high repetition rate and narrow pulse-width. The light source comprises a metal casing having coaxially mounted arcing electrodes therein which utilize the capacitance of the coaxial system to charge up to the arcing potential. One electrode is electrically connected to the end wall of the casing to provide a reflected wavefront from the end wall after an arc has been struck, such wavefront serving to extinguish the arc and thus provide a sharp pulse. The lamp may be used for such areas as photochemical and photobiological research, in place of much costlier nanosecond lasers.

15 Claims, 4 Drawing Figures

HIGH-INTENSITY LAMP HAVING HIGH PULSE REPETITION RATE AND NARROW PULSE-WIDTH

The purpose of the present invention is to provide a high intensity light source having high repetition rate and narrow pulse-width.

Conventionally, gas lasers are employed to provide narrow pulse-width, high intensity light for use in such laboratory areas as photochemistry and photobiology. Such lasers are extremely efficient but also very expensive, and it has therefore been found desirable to develop a light source of similar capability and flexibility but of considerably lower cost. Many such attempts have centered upon use of a high-voltage arc gap to generate a light pulse, which is focussed through a conventional lens system upon the material to be studied. An early attempt to utilize such an arc gap comprised a high voltage power supply connected across the gap, a parallel-connected capacitor to store the energy from the power supply and a thyratron in series with the gap to complete the circuit, when triggered, and thus permit the capacitor to discharge across the gap. In a refinement of this system, the thyratron was replaced by a pulse transformer having a low-voltage primary winding, which was both cheaper and more efficient. However, the problem remained to obtain the necessary pulse width and intensity characteristics for the lamp to be usable in place of a nanosecond laser in photochemical and photobiological research.

In the system of the invention, an arc gap is defined by axially aligned electrodes, coaxially located in a metallic, tubular gas-tight casing. A high-energy pulse is applied to one electrode and the energy is stored in the capacitance between the electrode and the casing. The other gap electrode extends from and is electrically connected to the metallic casing end wall so that, as an arc is struck across the gap, the high voltage wavefront propagates rapidly towards the end wall and is reflected therefrom as an out-of-phase pulse which extinguishes the arc across the gap. The result is an extremely sharp light pulse from the arc due to the abbreviated decay time caused by the extinguishing effect of the reflected wavefront. Additionally, the metallic construction of the casing ensures a high degree of shielding against radio-frequency interference, which is important in such applications as electron-spin resonance spectrometry. The casing may contain any conventional working gas fill, such as hydrogen, neon, air, etc. and means may be provided for the application of the desired gas to the casing interior, as required. Light from the arc gap leaves the casing through a light transparent portion of the casing wall and—where required—a lens system is provided to focus the emitted light.

In a preferred embodiment of the present invention, dual series-connected gaps are employed, the first of such gaps having a higher breakdown voltage than the second. A high-energy pulse is applied to one side of the first gap and is stored in the capacitance of the coaxial system, the capacitor being charged to the breakdown voltage of the gap. At this point the gap breaks down and the high voltage wavefront propagates rapidly down the line to the second gap. Simultaneously, the capacitance of the coaxial system re-charges rapidly and, in view of the lower breakdown voltage of the second gap, the gap breaks down immediately with a sharp, extremely high intensity flash.

The invention will now be described further by way of example only and with reference to the accompanying drawings, in which.

Figure 1:
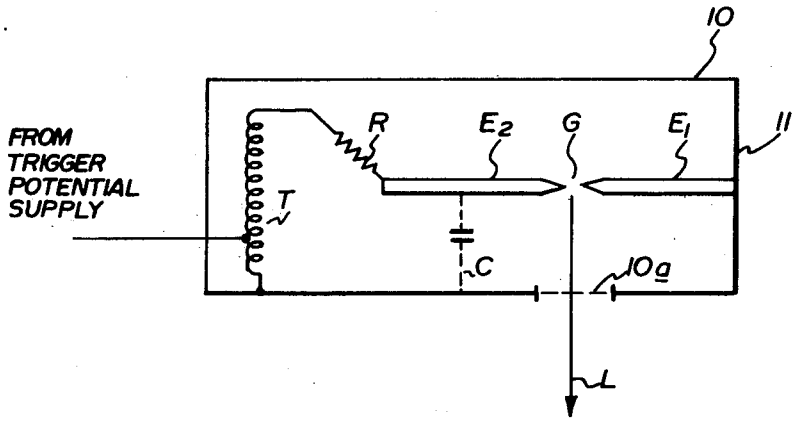
FIGS. 1 and 2 are schematic diagrams of lamps constructed according to the present invention.

Referring firstly to FIG. 1, a metal tube 10 contains a high-voltage coil T having a coil resistance R and a pair of electrodes $E_1$, $E_2$ defining an arc gap G and located co-axially of the tube. The coil T is connected to electrode $E_2$ and the electrode $E_1$ is grounded to the end wall 11 of the tube. The tube 10 is made light-transparent in a region 10*a* to permit the passage therethrough of a light flash L from the arc gap.

In operation, a potential is applied to the gap G from the auto transformer coil T. The capacitance C between the electrode $E_2$ and the tube 10 stores charge until the breakdown potential of the arc gap is reached. The gap then arcs across and, depending upon the gas fill and applied voltage, a high intensity flash of appropriate wave length is emitted, as shown at L. As the gap breaks down, the wavefront propagates rapidly along electrode $E_1$ and is reflected back from the tube end wall 11 as an out-of-phase pulse which effectively extinguishes the arc struck across the gap. Thus, the natural decay time of the arc is greatly abbreviated, giving a light flash of narrow pulse-width.

Figure 2:
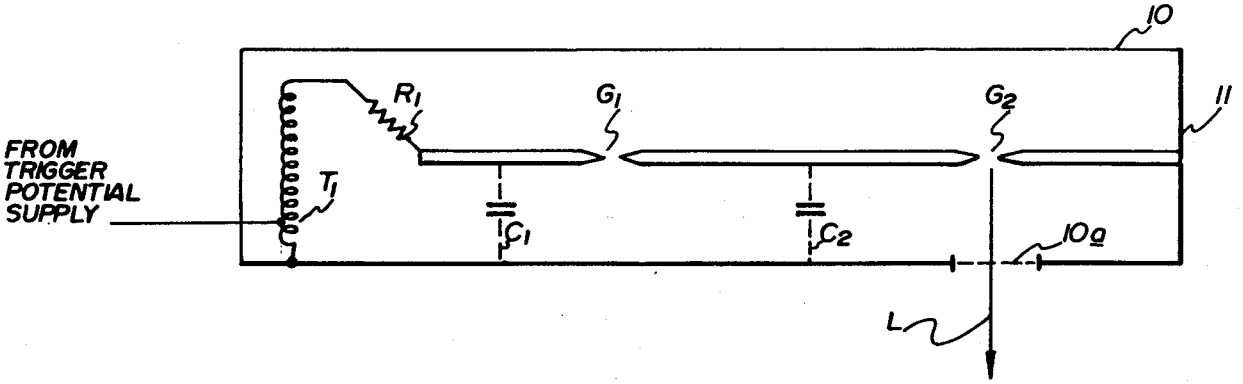

In the preferred embodiment shown in FIG. 2, a dual gap system is shown. A metallic casing 10 having an end wall 11 and a light-transparent portion 10*a* is again employed to house the lamp components. $T_1$ comprises a high-voltage auto transformer coil producing between 12 and 15 KV and triggered by a conventional trigger source (not shown). The high voltage is applied through the coil resistance $R_1$ and charges the capacitance $C_1$ of the coaxial system relatively slowly in accordance with the RC time constant of the circuit (typically about 1 microsecond). The gap $G_1$ is set to break down at about 10KV and, upon so doing, the voltage charges up the capacitance $C_2$. In the absence of significant resistance between gap $G_1$ and capacitance $C_2$, the latter charges up quickly (about 1 nanosecond), and the wavefront is propagated down the line towards the second spark gap $G_2$. The gap $G_2$ is adjusted to break down at about 5KV and hence breaks down immediately upon arrival of the fast travelling 10KV pulse, giving a high intensity spark. In this case, the wavefront passing from the gap $G_2$ is reflected from the end wall 11 of the tube and is propagated back up the tube out of phase with the incoming wavefront, thus providing a "zero pulse" effect which extinguishes the arcs across the gaps $G_1$ and $G_2$ and thus abbreviates the natural decay time of the arcs. In this condition, the system is then immediately ready for a new pulse from the coil $T_1$, thus providing for a very high pulse repetition rate—typically up to 15,000 pulses per second.

Light from the spark across gap $G_2$ emerges through the transparent portion 10*a* of the casing 10.

Figure 3:
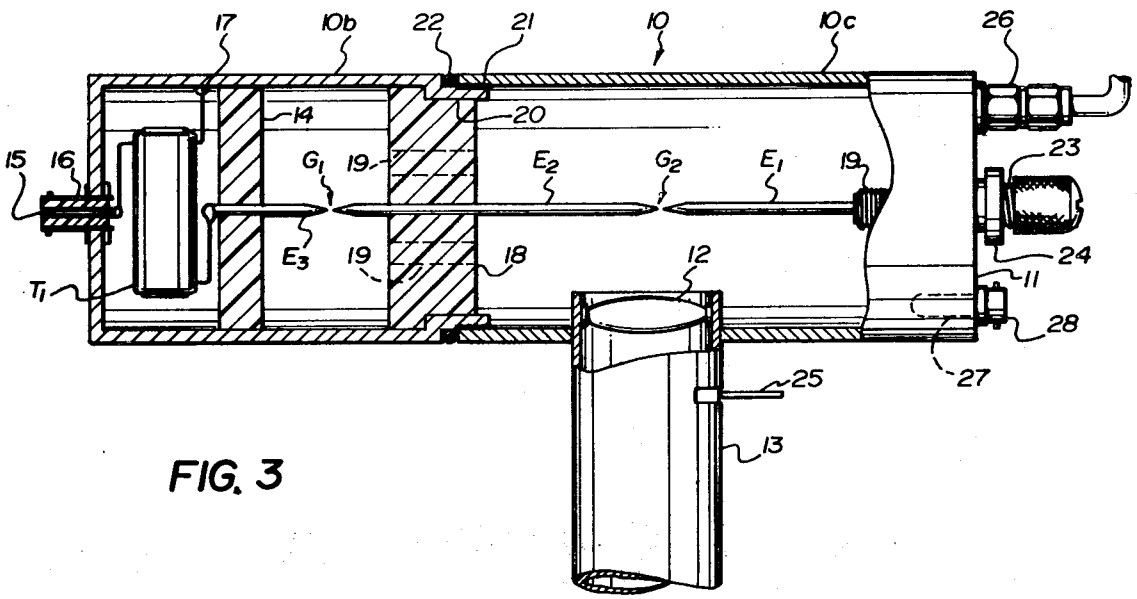
FIG. 3 is a side view, partially in section, of a preferred embodiment of the invention.

Turning now to FIG. 3, there is shown a lamp construction in accord with the preferred embodiment schematically shown in FIG. 2. The tube 10 is in two sections, designated 10*b* and 10*c*, respectively. The tube section 10*b* contains the coil $T_1$ and a first electrode $E_3$, supported centrally within the tube section by means of a plug 14 of resin or similar insulating material. The tapped connection to the auto transformer coil is soldered to the socket 15 of a conventional bayonet-type coaxial female connector 16 extending through the end wall of the tube section **10*b*, the connector being adapted to receive a complementary male connector element from a trigger generator. One end of the coil winding is soldered to the electrode $E_3$ and the other end of the coil is soldered to the tube wall at location 17**.

A second electrode $E_2$ is also located centrally within the section **10*b* and supported by means of a resin plug 18. The electrodes $E_2$ and $E_3$ are coaxially located and separated by the gap $G_1$. The plug is provided with through holes 19 to permit access of working gas from the tube section 10*c* to the section 10*b*. The open end of the tube section 10*b* is stepped to provide a region of reduced diameter 20 having a male thread formed therearound. The open end of the tube section 10*c* has a complimentary female thread formed therearound and the two sections are thus threadedly engageable as at 21 in FIG. 3. A rubber O-ring 22 is located around the stepped portion 20 of tube section 10*b* and serves to seal the coupling between the two sections against the leakage of gas therepast. The third electrode $E_1$ is located coaxially with electrode $E_2$ and is separated therefrom by gap $G_2$. However, the gap $G_2$ is made to be adjustable by mounting the electrode $E_1$ coaxially with and projecting from the end of a screw 23. The screw 23 passes through a complementarily threaded collar 24 welded to the exterior of the end wall 11 of the tube section 10*c*. Thus, the gap width may be adjusted by appropriate rotation of the screw 23, whilst the lamp is in operation, to provide the maximum output therefrom for any particular gas fill and pressure conditions within the tube section 10*c*. Light from the arc struck across the gap passes through a conventional lens system 12 (only one lens is shown in FIG. 3) contained in the lens turret 13, whereby the light may be focussed upon the material to be studied. For convenience, a focussing lever 25** is provided externally of the lens turret, the circumferential turning of which about the turret is translated into axial movement of the focussing lens element (not shown).

The appropriate gas fill is introduced into the interior of the tube through a conventional gas-line fitting 26. A probe coil 27 extends into the interior of the tube section **10*c* and is connected through the end wall 11 with a conventional bayonet-type coaxial fitting 28. The fitting 28 may be coupled to a piece of ancillary equipment which is fed by timing pulses from the probe 27**, such pulses being generated in the probe by electromagnetic radiation from the spark gap $G_2$. Thus, the ancillary equipment may be triggered precisely in time with the light flashes emitted by the lamp.

Extended testing of a lamp constructed according to the embodiment of FIG. 2 over a continuous period of forty-eight hours demonstrated the great stability in frequency and amplitude of the pulses emitted at repetition rates up to 15,000 pulses per second. Depending upon the gas fill used, the lamp has an intensity of up to $10^9$ photons per pulse with radio-frequency interference of less than 0.1%. Indeed the RF shielding is so effective that measurements of $10^{-8}$ M anthracene samples have been possible. Performance data for the lamp is given below. The lamp body was constructed from aluminum and tungsten steel was used for the electrode tips. The lamp tube was 29.0 cm. in length and 4.2 cm. internal diameter.

Probe coil output pulse rise time—2 nanoseconds; source impedance—50 ohms, width—10 nanoseconds.

Lamp operating voltage 5–15 KV.

Repetition rate 100–25,000 Hz (for extended use over 2 hours use only up to 15,000 pps).

Output *f* number of lens system—*f*/3.0

Arc length—3 mm (adjustable)

Optical pulse characteristics,

| (at 1 atm. pressure) | INTENSITY (photons/flash) | FWHM* (nanoseconds) | MAIN OPTICAL PEAK (nanometers) |
|---|---|---|---|
| N | $2 \times 10^9$ | 2.5 | 337 |
| Air | $5 \times 10^8$ | 2.0 | 337 |
| $D_2$ | $4 \times 10^7$ | 2.0 | 275 - 325 |
| $H_2$ | $2 \times 10^7$ | 2.0 | 275 - 325 |

*full pulse width at half maximum pulse height - may vary ±10%, depending on adjustment Optical pulse rise time, 1.0–1.5 nanoseconds (depending on gas used).

Figure 4:
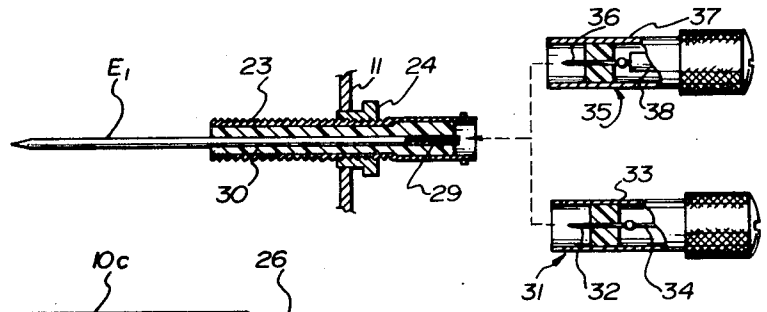
FIG. 4 is a side view, partially in section, of an electrode assembly for use in yet a further embodiment of the invention.

In an alternative embodiment of the invention, as shown in FIG. 4, the screw 23 is terminated in a bayonet-type female coaxial connector, the socket 29 of such connector being formed at the outer end of the electrode $E_1$. Both electrode $E_1$ and socket 29 are insulated from the exterior of the screw—and thus from the collar 24 and tube end wall 11—by a sleeve of insulating resin 30. In order to complete the connection of the electrode $E_1$ to the tube end wall 11, a selection of two coaxial male plugs is available. In the first plug 31, the centre pin 32 is directly connected to the outer casing 33 of the plug by wire 34. Thus, when the plug 31 is inserted in the female connector portion of screw 23, electrode $E_1$ is directly connected to the tube end wall 11 and the lamp functions as hereinbefore described. However, in the event that the extinguishing effect of the reflected wavefront upon the arc gaps is not desired—for example, if a pulse of longer duration is required—such effect can easily be achieved by electrically isolating the electrode $E_1$ from the tube end wall. In practice, it is necessary to properly terminate the transmission line defined by electrodes $E_1$ to $E_3$ with a resistance matched to the impedance of the coaxial system. To this end, a second plug 35 is employed in place of plug 31, the plug 35 having its pin 36 connected to the outer casing 37 of the plug through a matching resistor 38. Both plugs 31 and 35 are provided with slotted, knurled heads 40 and 41, respectively, in order to provide for convenient turning of the screw 23 when one or other plug is secured to the end thereof, in order to vary the arc gap $G_2$ as hereinbefore described.

We claim:

1. A high intensity light source comprising a metallic, tubular gas-tight casing having spaced arcing electrodes located internally of said casing and a portion of the casing wall being light transparent and located relative to said arcing electrodes to permit the passage of light therethrough from an arc struck across said electrodes, a first of said electrodes extending from an end wall of said metallic casing and electrically connected thereto and a second of said electrodes being connected to means for applying an arcing potential thereto, and said electrodes being coaxially mounted with respect to said tubular casing whereby said second electrode is capacitively coupled thereto; and a third coaxially mounted electrode, spaced from said second electrode and forming a second arc gap therewith having a higher breakdown potential than the gap between said first and second electrodes, said third electrode being connected to means for applying an arcing potential thereto and said third electrode being capacitively coupled to said casing.

2. The high intensity light source of claim 1, wherein said first electrode is movable axially of said casing to vary the arc gap width between said first and second electrodes.

3. The high intensity light source of claim 2, wherein said first electrode is coaxially mounted upon an externally threaded screw member which passes through said end wall in threaded engagement therewith, said screw member being accessible from the exterior of said casing to permit the application of clockwise or counterclockwise rotation thereto.

4. The high intensity light source of claim 3, wherein said first electrode and said casing end wall are electrically connected through said screw.

5. The high intensity light source of claim 3, wherein said first electrode is insulatively mounted upon said screw member; and means for provided for selectively electrically connecting said first electrode to said screw member either directly or through resistance means matched to the impedance of the coaxial system.

6. A high intensity light source comprising a metallic, tubular, gas-tight casing having first and second serially-connected arc gaps therein defined by first, second and third axially aligned electrodes positioned coaxially with respect to said tubular casing; said second and third electrodes defining said first arc gap and being capacitively coupled to said casing; said first electrode being electrically connected to said casing and, together with said second electrode, defining said second arc gap; means for applying an arcing potential to said third electrode sufficient to strike an arc across said first arc gap and across said second arc gap, said first arc gap having a higher breakdown potential than said second arc gap; and said first electrode extending from an end wall of said casing and movable axially of said casing to permit adjustment of the width of said second arc gap; and a portion of the casing wall being light transparent and located relative to said second arc gap to permit the passage of light therethrough from an arc struck across said gap.

7. The high intensity light source of claim 6, wherein said casing is formed as two interfitting tubular sections, a first of said sections containing said first electrode and a second of said sections containing said second and third electrodes, said second electrode being mounted within said second section to extend inwardly towards said third electrode to define said first arc gap and outwardly of said second section to penetrate into said first section, when said sections are interfitted, to form said second arc gap.

8. The high intensity light source of claim 7, wherein first and second electrically insulative bulkhead members are provided for respectively mounting said second and third electrodes, said first bulkhead member having channels therethrough to permit the passage of gas between the two casing sections in their interfitted condition.

9. The high intensity light source of claim 8, wherein said second bulkhead member is spaced from the end wall of said second section to define a chamber, said chamber containing a high-voltage coil having a secondary connection connected to said third electrode and a primary connection connected to means for connection to a potential supply source.

10. The high intensity light source of claim 7, wherein said tubular sections are cylindrical and complementarily threaded at their respective inner and outer walls to permit axial threaded engagement of said sections to form said casing.

11. The high intensity light source of claim 10, further comprising gasket means interposed between the interfitted casing sections to provide a gas-tight seal.

12. The high intensity light source of claim 5, further comprising an optical focussing system located upon said casing wall at the light transparent portion thereof to focus light rays emitted from an arc struck across said electrodes.

13. The high intensity light source of claim 12, wherein said optical focussing system comprises a lens assembly including an adjustable focussing lens, said assembly mounted in a metallic turret structure extending from and electrically grounded to said casing wall.

14. The high intensity light source of claim 1, wherein gas inlet means are provided in said casing wall to permit the application of a working gas fill to the casing interior.

15. The high intensity light source of claim 7, wherein gas inlet means are provided in the wall of said first tubular section to permit the application of a working gas fill to the casing interior.

* * * * *